United States Patent [19]

Macaluso et al.

[11] Patent Number: 4,942,830

[45] Date of Patent: Jul. 24, 1990

[54] PAPER-PRODUCT SHELVING CONSTRUCTION

[75] Inventors: Vincent A. Macaluso, Trappe, Pa.; Conrad Hade, South Salem, N.Y.

[73] Assignee: Cornerboard, Inc., Bridgeport, Pa.

[21] Appl. No.: 257,356

[22] Filed: Oct. 13, 1988

[51] Int. Cl.[5] ..... A47B 3/00

[52] U.S. Cl. ..... 108/111; 312/259; 211/195

[58] Field of Search ..... 108/111, 153; 211/149, 211/135, 195; 248/174; 312/259; 206/44 R, 45, 45.31

[56] References Cited

U.S. PATENT DOCUMENTS

| | | | |
|---|---|---|---|
| 2,290,144 | 7/1942 | Katz | 108/111 |
| 3,685,775 | 8/1972 | Fortunato | 248/174 |
| 4,333,622 | 6/1982 | Albano | 108/111 X |
| 4,506,790 | 3/1985 | Muscari | 108/111 X |
| 4,519,319 | 5/1985 | Howlett | 108/111 |
| 4,630,740 | 12/1986 | Belokin, Jr. | 248/174 X |
| 4,773,538 | 9/1988 | Crawford | 312/259 X |

*Primary Examiner*—Jose V. Chen

*Attorney, Agent, or Firm*—Ratner & Prestia

[57] ABSTRACT

A paper-product shelving construction composed of a single-piece paper-product shroud and a shelving assembly, fitted within the shroud, and formed from paper-product components. The shelving assembly includes a plurality of fluted shelf members extending between a pair of support walls. The shroud includes a back wall, two sidewalls and an open front face. A pair of flaps folded from the tops of the front face and the back wall each have a locking flap which is folded downward into aligned slots formed by two pairs of side flaps folded from the tops of the two sidewalls.

16 Claims, 2 Drawing Sheets

PAPER-PRODUCT SHELVING CONSTRUCTION

TECHNICAL FIELD

The present invention relates, in general, to shelving constructions and, in particular, to a shelving construction fabricated from paper products and which can be assembled by the user. Although the invention is particularly useful for storing file storage boxes, it will be apparent that the potential applications of the invention are much broader.

BACKGROUND OF THE INVENTION

A vast variety of shelving constructions are in use today. Among the materials used to form these shelving constructions are metals, woods and paper products. Generally, the application of the shelving dictates the choice of the shelving material and the design of the construction.

Document retention and storage have been and continue to be major concerns of many businesses. Many businesses have their own storage facility. Others use the facilities of businesses which provide storage services. Some do both.

The well-known paper-product file storage boxes, which are assembled by the user, are in widespread use. When these boxes and their contents are stored by the user, often the boxes are stacked one on top of the other rather than being placed on permanent shelving. This results either because of the expense of permanent shelving or the lack of space for permanent shelving or both. Consequently, gaining access to a particular box to retrieve a particular document can be troublesome. In addition, if the contents of the boxes are heavy, the boxes at the bottom of the stack can break because the boxes are designed to support their contents and not the contents of a plurality of boxes.

DISCLOSURE OF THE INVENTION

A paper-product shelving construction, constructed in accordance with the present invention, includes a shroud formed from a single-piece paper-product and a shelving assembly, fitted within the shroud, and composed of paper-product components. The shroud includes: (a) a back wall, (b) a first sidewall folded at 90° from the back wall, (c) an open front face folded from the first sidewall and extending parallel to the back wall, (d) a second sidewall folded from the front face and extending parallel to the first sidewall, (e) means for attaching a free edge of the second sidewall to a free edge of the back wall, (f) the first pair of top side flaps folded from the top of the first sidewall toward the second sidewall and forming a slot extending between the first pair of top side flaps from the first sidewall toward the second sidewall, (g) a second pair of top side flaps folded from the top of the second sidewall toward the first sidewall and forming a slot extending between the second pair of top side flaps from the second sidewall toward the first sidewall with the slot between the second pair of top side flaps aligned with the slot between the first pair of top side flaps, (h) a top front flap folded from the top of the front face toward the back wall and having a first locking flap folded downward into the aligned slots between the first and the second pairs of top side flaps, and (i) a top back flap folded from the top of the back wall toward the front face and having a second locking flap folded downward into the aligned slots between the first and the second pairs of top side flaps. The shelving assembly, which is fitted within the shroud, has: (a) a first paper-product support wall positioned adjacent the first sidewall of the shroud and having a first plurality of horizontal slots extending parallel to the first sidewall of the shroud, (b) a second paper-product support wall positioned adjacent the second sidewall of the shroud and having a second plurality of horizontal slots extending parallel to the second sidewall of the shroud with each of the slots of the second plurality of slots horizontally aligned with a slot of the first plurality of slots, and (c) a plurality of paper-product fluted shelf members each fitted within a pair of horizontally aligned slots in the first and the second support walls.

BEST MODES FOR CARRYING OUT THE INVENTION

Figure 1:
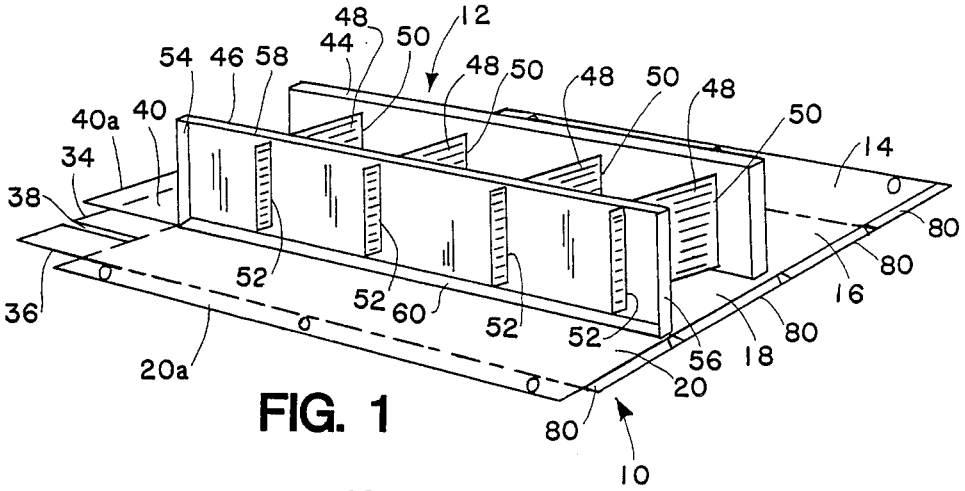
FIG. 1 perspective view of a first preferred embodiment of a paper-product shelving construction, constructed in accordance with the present invention stage in its assembly.
Figure 2:
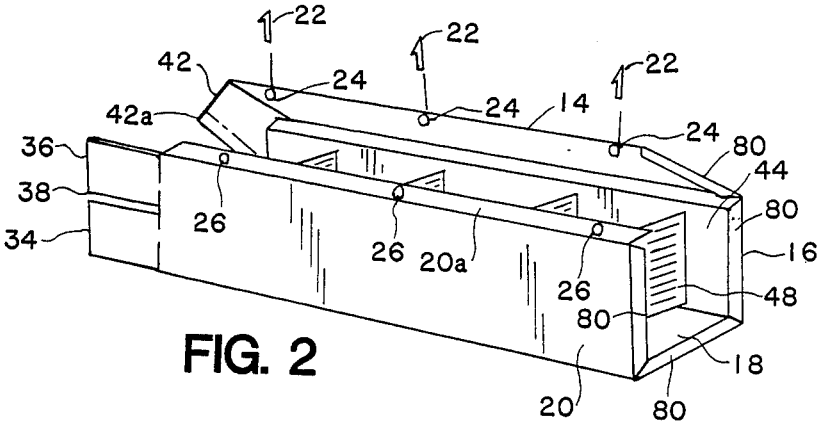
FIG. 2 is a perspective view of the FIG. 1 embodiment of the invention at a second stage in its assembly.
Figure 3:
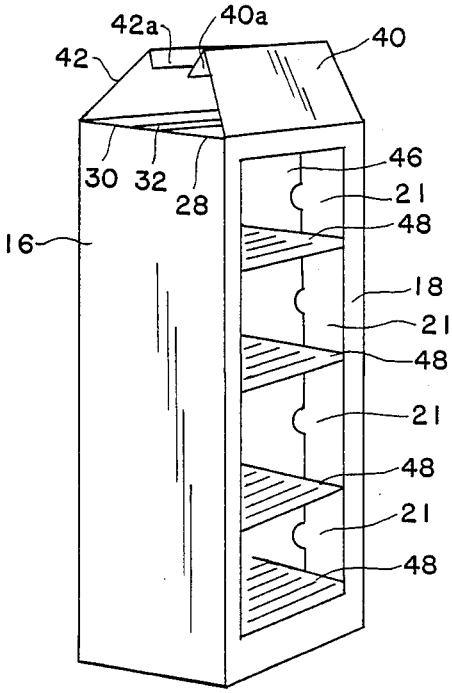
FIG. 3 is a perspective view of the FIGS. 1 and 2 embodiment of the invention in its standing position.

Referring to FIGS. 1, 2 and 3, a paper-product shelving construction, constructed in accordance with the present invention, includes a shroud 10, formed from a single-piece paper-product, and a shelving assembly 12 composed of paper-product components. As used herein, the term "paper-product" includes materials composed of paper, paper board, cardboard, corrugated board, and the like in single-piece, single-ply or laminate arrangements.

Shroud 10 includes (a) a back wall 14, (b) a first sidewall 16 folded at 90° from back wall 14, (c) an open front face 18 folded from sidewall 16 and extending parallel to back wall 14, (d) a second sidewall 20 folded from front face 18 and extending parallel to sidewall 16, and (e) means for attaching a free edge of sidewall 20 to a free edge of back wall 14. For the embodiment of the invention shown in FIG. 3, front face 18 has a single, vertical opening formed when a plurality of pairs of front face flaps are folded inward of the shroud along vertical lines. Only one front face flap 21 of each pair of front face flaps is shown in FIG. 3. Also, for the embodiment of the invention shown in FIGS. 1 and 2, sidewall 20 is attached to back wall 14 by a plurality of mechanical fasteners 22, such as plastic toggle bolts, extending through a plurality of aligned openings 24 and 26 in back wall 14 and an extension flap **20*a* of sidewall 20**, respectively.

Shroud 10 also includes a first pair of top side flaps 28 and 30 folded from the top of sidewall 16 toward sidewall 20 and forming a slot 32 extending between top side flaps 28 and 30 from sidewall 16 toward sidewall 20. A second pair of top side flaps 34 and 36 is folded from the top of sidewall 20 toward sidewall 16 and forms a slot 38 which extends from sidewall 20 toward sidewall 16 and is aligned with slot 32 between top side flaps 28 and 30.

Shroud 10 further includes top front flap 40 and top back flap 42. Top front flap 40 is folded from the top of front face 18 toward back wall 14 and has a first locking flap 40*a* folded downward in aligned slots 32 and 38 between top side flaps 28 and 30 and top side flaps 34 and 36, respectively. Top back flap 42 is folded from the top of back wall 14 toward front face 18 and has a second locking flap 42*a* folded downward in aligned slots 32 and 38.

Shelving assembly 12 includes a first paper-product support wall 44, a second paper-product support wall 46, and a plurality of paper-product fluted shelf members 48. Support wall 44 is positioned adjacent sidewall 16 of shroud 10 and has a plurality of horizontal slots 50 extending parallel to sidewall 16. Support wall 46 is positioned adjacent sidewall 20 of shroud 10 and has a plurality of horizontal slots 52 extending parallel to sidewall 20. Each shelf member 48 is fitted within a pair of horizontally aligned slots 50 and 52.

Support wall 46 has an upper flap 54, a lower flap 56 and two side flaps 58 and 60 which add strength and rigidity to the support wall. Likewise, support wall 44 has an upper flap, a lower flap and two side flaps.

Fluted shelf members 48 can be cut from lengths of BIG FLUTE TM brand "no-face" corrugated paperboard supplied by Cornerboard Inc., the assignee of this application. This product, because of its fluted configuration, provides significant strength and rigidity to shelf members 48.

The shelving construction shown in FIGS. 1, 2 and 3 is assembled as follows. Shelving assembly 12 is put together by fitting the opposite ends of each shelf member 48 into associated slots 50 and 52 in support walls 44 and 46, respectively. With shelving assembly 12 positioned on the inside surface of front face 18 of shroud 10 as shown in FIG. 1, sidewalls 16 and 20 of the shroud are folded upward as shown in FIG. 2. Next, back wall 14 is folded downward as shown in FIG. 2 and with the free edge of the back wall positioned against extension flap 20*a* of sidewall 20, mechanical fasteners 22 are inserted into the aligned openings 24 and 26 in back wall 14 and extension flap 20*a*, respectively. The shelving construction then is positioned upright and top side flaps 28, 30, 34 and 36 are folded to present aligned slots 32 and 38 for reception of locking flaps 40*a* and 42*a* of top front flap 40 and top back flap 42, respectively. Next, top front flap 40 and top back flap 42 are folded downward and locking flaps 40*a* and 42*a* are folded downward into aligned slots 32 and 38. Finally, front face flaps 27 are folded inward of the shroud to extend parallel to support walls 44 and 46. Front face flaps 27 are arranged to bear against the tops and bottoms of shelf members 48 to add strength and rigidity to the shelving construction.

Figure 4:
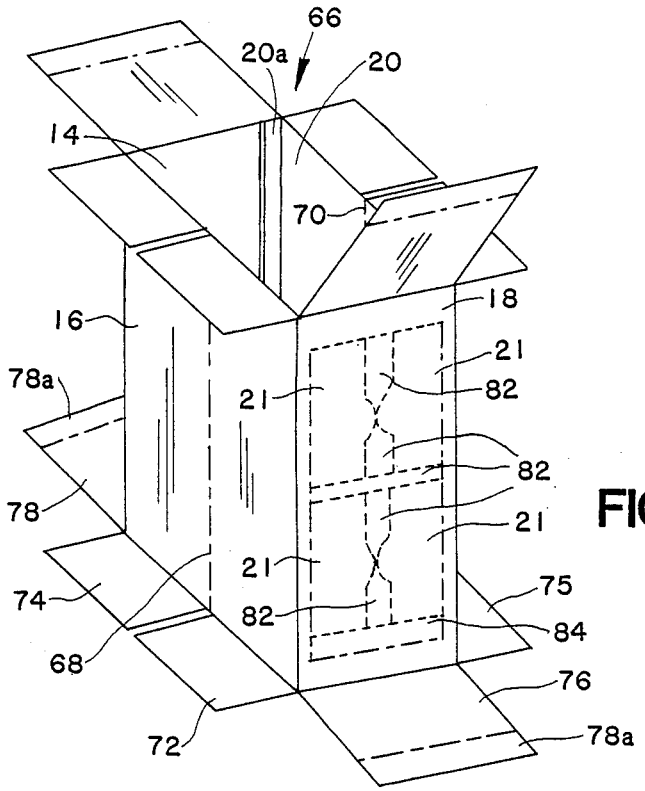
FIG. 4 is a perspective view of a second preferred embodiment of the shroud portion of a paper-product shelving construction constructed in accordance with the present invention.

FIG. 4 shows a second embodiment of a shroud constructed in accordance with the present invention. Shroud 66 in FIG. 4 differs from shroud 10 in FIGS. 1 and 2 in two ways. First, in shroud 66, attachment flap 20*a* of sidewall 20 is attached to back wall 14 by means of an adhesive. This attachment may be made by the user by removing a backing strip from an adhesive on either the back wall or the extension flap, or the shroud can be supplied with attachment flap 20*a* already secured to back wall 14. In the latter case, sidewalls 16 and 20 are provided with vertical fold-lines 68 and 70, so that the shroud has a accordion construction and can be collapsed for shipment as the centers of the sidewalls are pushed inward or pulled outward.

Shroud 66 also differs from shroud 10 by the inclusion of a first pair of bottom side flaps 72 and 74, a second pair of bottom side flaps (only one of which is shown in FIG. 4 and is identified by reference numeral 75), a bottom front flap 76, and a bottom back flap 78. This arrangement, which is assembled in the same manner as is the top of the shroud, provides the same construction at the bottom of the shroud as is present at the top of the shroud and thereby increases the strength and rigidity of the shroud. Bottom side flaps, a bottom front flap and a bottom back flap may be included in shroud 10 in FIGS. 1 and 2 instead of the partial flaps 80 as illustrated.

Figure 5:
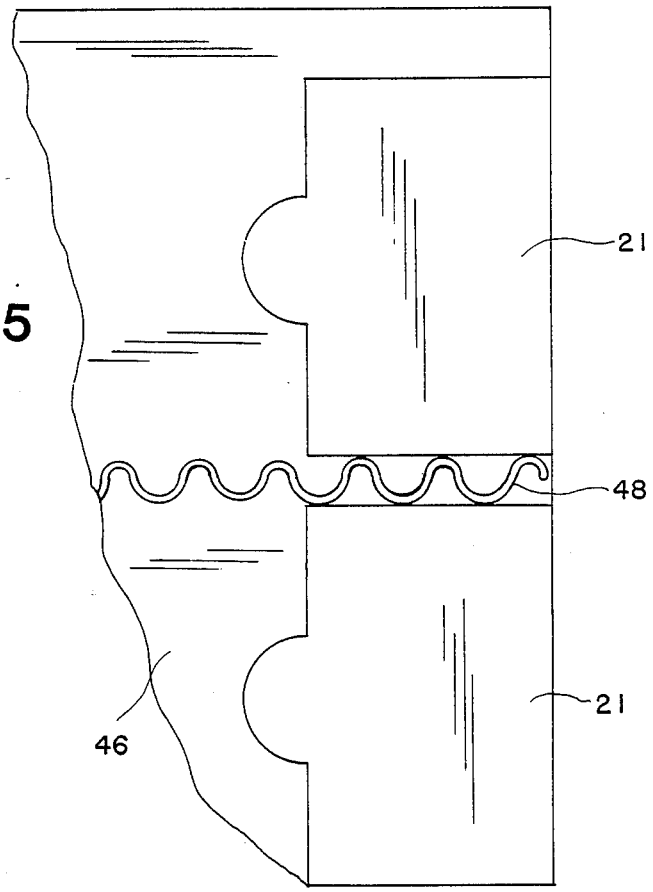
FIG. 5 is a side view of a portion of a paper-product shelving construction constructed in accordance with the present invention.

FIG. 4 also is useful in understanding how front face 18 is arranged. Front face flaps 21 are formed by tearing along the tear lines represented by the dashed lines, and the opening in the front face is formed by folding front face flaps 21 into the shroud along the vertical fold lines represented by the dot-dash lines. Knock-outs 82 are discarded. The spacing between the upper edges of one pair of front face flaps and the lower edges of the next pair of front face flaps corresponds to the thickness of shelf members 48, so that the lower edges of the front face flaps bear against the tops of the shelf members and the upper edges of the front face flaps bear against the bottoms of the shelf members when the front face flaps are folded inward of the shroud. This is shown most clearly in FIG. 5 and adds strength and rigidity to the shelving construction. In addition, a front sill flap 84, folded inward of the shroud, may be provided at the bottom of the opening in the front face to prevent articles from falling beneath the lowermost shelf member.

The foregoing has set forth exemplary and preferred embodiments of the present invention. It will be understood, however, that various alternatives will occur to those of ordinary skill in the art without departure from the spirit and scope of the present invention.

We claim:

1. A paper-product shelving construction comprising:

a shroud formed from a single-piece paper-product and having:

(a) a back wall (b) a first sidewall folded at 90° from said back wall, (c) a front face folded from said first sidewall and extending parallel to said back wall, said front face having a defined opening, (d) a second sidewall folded from said front face and extending parallel to said first sidewall, (e) means for attaching a free edge of said second sidewall to a free edge of said back wall, (f) a first pair of top side flaps folded from the top of said first sidewall toward said second sidewall and forming a slot extending between said first pair of top side flaps from said first sidewall toward said second sidewall, (g) a second pair of top side flaps folded from the top of said second sidewall toward said first sidewall and forming a slot extending between said second pair of top side flaps from said second sidewall toward said first sidewall, said slot between said second pair of top side flaps aligned with said slot between said first pair of top side flaps, (h) a top front flap folded from the top of said front face toward said back wall and having a first locking flap folded downward into said aligned slots between said first and said second pairs of top side flaps, and (i) a top back flap folded from the top of said back wall toward said front face and having a second locking flap folded downward into said aligned slots between said first and said second pairs of top side flaps;

and a shelving assembly fitted within said shroud and having:

(a) a first paper-product support wall positioned adjacent said first sidewall of said shroud and having a first plurality of horizontal slots extending parallel to said first sidewall of said shroud, (b) a second paper-product support wall positioned adjacent said second sidewall of said shroud and having a second plurality of horizontal slots extending parallel to said second sidewall of said shroud, each of said slots of said second plurality of slots horizontally aligned with a slot of said first plurality of slots, and (c) a plurality of paper-product fluted shelf members each fitted within a pair of horizontally aligned slots in said first and said second support walls.

2. A paper-product shelving construction according to claim 1 wherein said shroud further includes:

(1) a first pair of bottom side flaps folded from the bottom of said first sidewall toward said second sidewall and forming a slot extending between said first pair of bottom side flaps from said first sidewall toward said second sidewall, (2) a second pair of bottom side flaps folded from the bottom of said second sidewall toward said first sidewall and forming a slot extending between said second pair of bottom side flaps from said second sidewall toward said first sidewall, said slot between said second pair of bottom side flaps aligned with said slot between said first pair of bottom side flaps, (3) a bottom front flap folded from the bottom of said front face toward said back wall and having a third locking flap folded upward into said aligned slots between said first and said second pairs of bottom side flaps, and (4) a bottom back flap folded from the bottom of said back wall toward said front face and having a fourth locking flap folded upward into said aligned slots between said first and said second pairs of bottom side flaps.

3. A paper-product shelving construction according to claim 2 wherein said shroud further includes a plurality of pairs of front face flaps, each pair of said front face flaps including:

(1) a first flap folded inward of said shroud from said front face along a vertical line and extending parallel to said first support wall, and (2) a second flap folded inward of said shroud from said front face along a vertical line and extending parallel to said second support wall.

4. A paper-product shelving construction according to claim 3 wherein each of said sidewalls of said shroud has a vertical fold-line extending along its entire length.

5. A paper-product shelving construction according to claim 2 wherein each of said sidewalls of said shroud has a vertical fold-line extending along its entire length.

6. A paper-product shelving construction according to claim 1 wherein said shroud further includes a plurality of pairs of front face flaps, each pair of said front face flaps including:

(1) a first flap folded inward of said shroud from said front face along a vertical line and extending parallel to said first support wall, and (2) a second flap folded inward of said shroud from said front face along a vertical line and extending parallel to said second support wall.

7. A paper-product shelving construction according to claim 6 wherein each of said sidewalls of said shroud has a vertical fold-line extending along its entire length.

8. A paper-product shelving construction according to claim 6 wherein said front face flaps have lower edges and upper edges, said shelf members have tops and bottoms, and said lower edges of said front face flaps bear against said tops of said shelf members and said upper edges of said front face flaps bear against said bottoms of said shelf members.

9. A paper-product shelving construction according to claim 6 wherein said shroud further includes an attachment flap folded from said second sidewall and extending parallel to said back wall and said attaching means include a of mechanical fasteners extending through said attachment flap and said back wall.

10. A paper-product shelving construction according to claim 6 wherein the lower edges of said front face flaps bear against the tops of said shelf members and the upper edges of said front face flaps bear against the bottoms of said shelf members.

11. A paper-product shelving construction according to claim 1 wherein each of said sidewalls of said shroud has a vertical fold-line extending along its entire length.

12. A paper-product shelving construction according to claim 1 wherein said shroud further includes an attachment flap folded from said second sidewall and extending parallel to said back wall and said attaching means include a plurality of mechanical fasteners extending through said attachment flap and said back wall.

13. A paper-product shelving construction according to claim 1 wherein said shroud further includes an attachment flap folded from said second sidewall adhesively attached to said back wall.

14. A paper-product shelving construction according to claim 10 wherein each of said sidewalls of said shroud has a vertical fold-line extending along its entire length.

15. A paper-product shelving construction according to claim 14 wherein said shroud further includes a plurality of pairs of front face flaps, each pair of said front face flaps including:

(1) first flap folded inward of said shroud from said front face along a vertical line and extending parallel to said first support wall, and (2) a second flap folded inward of said shroud from said front face along a vertical line and extending parallel to said second support wall.

16. A paper-product shelving construction according to claim 15 wherein said front face flaps have lower edges and upper edges, said shelf member have tops and bottoms, and said lower edges of said front face flaps bear against said tops of said shelf members and said upper edges of said front face flaps bear against said bottoms of said shelf members.

* * * * *

UNITED STATES PATENT AND TRADEMARK OFFICE

CERTIFICATE OF CORRECTION

PATENT NO. : 4,942,830

DATED : July 24, 1990

INVENTOR(S) : Vincent A. Macaluso, Conrad Hade

It is certified that error appears in the above-identified patent and that said Letters Patent is hereby corrected as shown below:

Column 6, line 49 Change "10" to --13--.

Signed and Sealed this

Twenty-sixth Day of November, 1991

*Attest:*

HARRY F. MANBECK, JR.

*Attesting Officer*

*Commissioner of Patents and Trademarks*